United States Patent [19]

Roeder

[11] Patent Number: 5,055,002

[45] Date of Patent: Oct. 8, 1991

[54] DOWNHOLE PUMP WITH RETRIEVABLE NOZZLE ASSEMBLY

[76] Inventor: George K. Roeder, P.O. Box 807, Big Sandy, Tex. 75755

[21] Appl. No.: 614,052

[22] Filed: Nov. 9, 1990

Related U.S. Application Data

[63] Continuation of Ser. No. 351,109, May 12, 1989, abandoned.

[51] Int. Cl.[5] ..... F04F 5/02

[52] U.S. Cl. ..... 417/172

[58] Field of Search ..... 417/151, 172, 358; 166/68

[56] References Cited

U.S. PATENT DOCUMENTS

| | | | |
|---|---|---|---|
| 3,687,573 | 8/1972 | McArthur et al. | 417/358 |
| 4,183,722 | 1/1980 | Roeder | 417/172 |
| 4,293,283 | 10/1981 | Roeder | 417/172 |
| 4,504,195 | 3/1985 | Binks et al. | 417/172 |
| 4,605,069 | 8/1986 | McClaflin | 166/310 |
| 4,658,893 | 4/1987 | Black | 417/172 |

*Primary Examiner*—Leonard E. Smith
*Assistant Examiner*—M. Kocharov
*Attorney, Agent, or Firm*—Marcus L. Bates

[57] ABSTRACT

A downhole jet pump has a nozzle assembly arranged respective to a pump housing whereby the nozzle assembly can be circulated uphole from the pump and circulated back downhole to the pump in order to renew the nozzle assembly. A special packer nose assembly enhances the retrieval and installation of the nozzle assembly within the downhole pump. The nozzle assembly is replaced without having to pull the pump.

22 Claims, 3 Drawing Sheets

DOWNHOLE PUMP WITH RETRIEVABLE NOZZLE ASSEMBLY

This is a continuation of application Ser. No. 07/351,109 filed May 12, 1989 now abandoned.

BACKGROUND OF THE INVENTION

Hydraulically actuated reciprocating downhole pumps are known to those skilled in the art as exemplified by the following George K. Roeder U.S. Pat. Nos. 4,084,923; 4,477,234; 4,768,589; and 3,957,400, for example only. The simplest of the downhole hydraulically actuated pumps involve a number of moving parts and are quite complex in operation. It is known to circulate the entire hydraulically actuated pump uphole and downhole in order to effect repairs thereon, or in order to replace one pump with another pump. Those skilled in the art are also familar with jet pumps that can be used in lieu of a reciprocating type hydraulically actuated downhole pump as evidenced by the Roeder U.S. Pat. Nos. 4,744,730; 4,293,283; and 4,183,722.

It is also old to combine a jet pump with a reciprocating type hydraulically actuated downhole pump as evidenced by the Roeder U.S. Pat. No. 4,202,656. It is also old to circulate the entire jet pump into and out of the borehole as evidenced by the Roeder U.S. Pat. Nos. 4,744,730 and 4,183,722. Sometimes to facilitate circulating the pump in and out of a hole, the packer nose assembly shown in Roeder U.S. Pat. No. 4,248,299 is advantageously employed.

There are many hydrocarbon producing slim hole wells that produce both gas and liquid, wherein the information gas pressure and volume is insufficient to lift the formation liquid to the surface, and these wells must therefore employ some sort of lifting device. These wells sometime will produce both gas and liquid for several hours and eventually become "loaded" as the well hydrostatic head overcomes the lifting action of the downhole gas pressure and the well is "killed" or "shuts itself in". When this happens, the well will remain shut-in until the downhole pressure builds up to a value that once again overcomes the hydrostatic head, whereupon the well will again flow and produce both gas and oil until the reflux action of the liquid presents a hydrostatic head that overcomes the available downhole gas pressure. This causes the well to again shut itself in. In instances such as this, an inexpensive downhole jet pump can be advantageously used to assure that the well is continuously produced, as contrasted to the well being shut-in at odd intervals of time. There are many advantages derived from continuously producing such a well as contrasted with shutting the well in until the downhole pressure has recuperated.

In a production well such as described, it is possible to recirculate the produced gas back downhole to the jet pump in order to lift the formation fluid with a jet action and thereby further enhance the production rate by utilizing the reinjected gas along with the produced gas as a sort of gas lift. This is considered part of the present invention.

It is old to place check valves within a packer nose assembly in order to circulate the entire pump assembly into and out of a borehole as evidenced by the following Roeder U.S. Pat. Nos. 4,293,283; 4,268,227; 4,214,854; 4,202,656; 4,118,154; 4,084,923 and 4,080,111.

Roeder U.S. Pat. No. 4,744,730 shows a jet pump of both the free and the fixed type.

The present invention provides a downhole jet pump that can be used for producing liquids as well as a mixture of liquid and gas; and provides improvements in the nozzle assembly and method and apparatus for which the nozzle assembly can be retrieved without pulling the pump from the borehole. This is especially advantageous in the fixed type downhole jet pump where the nozzle and throat is subjected to rapid wear, because it provides a great savings by avoiding the costly use of a pulling unit.

In this disclosure, the term fluid is intended to include gas, water, liquid hydrocarbons, and any other composition of matter that can be used as a power fluid and circulated downhole to operate a jet pump.

SUMMARY OF THE INVENTION

A downhole jet pump for producing fluid from a wellbore has a nozzle assembly received within a main body passageway and includes means thereon by which the nozzle assembly can be circulated out of the pump and out of a borehole and another nozzle assembly can be circulated downhole to the pump and into operative position therewith thereby enabling nozzle assemblies to be changed without the necessity of pulling the pump from the well.

The downhole pump of this invention has a main body made into several different component parts to provide a pump lower end having a formation fluid inlet, a pump upper end having a power fluid inlet, and a seating cavity formed between the upper and lower ends of the pump that receives the nozzle assembly therein such that the nozzle assembly is oriented to receive power fluid and use the power fluid to produce the formation fluid, with the partially spent power fluid and formaiton fluid exiting the nozzle assembly and being returned uphole from the pump.

More specifically, the present invention provides a downhole jet pump for producing fluid from a wellbore. The pump can be run downhole on the end of a power fluid string. The pump has a main body through which a pasageway extends, with the upper end of the passageway providing a power fluid source, and the lower end of the passageway providing a formation fluid inlet. A seating cavity is formed between the upper and lower end of the passage, and a nozzle assembly is removably received within the seating cavity.

Means provide a flow path from the lower end to said nozzle working area; and means provides a flow path from the discharge to the mixed fluid outlet. This is achieved by a novel arrangement of the pump interior and nozzle assembly.

The nozzle assembly has a nozzle at one end thereof connected to the power fluid, a throat at the other end thereof having an inlet spaced from the nozzle outlet, with the area between the nozzle outlet and throat inlet being a working area that is always optimally positioned within the pump to receive the formation fluid in a novel manner.

The working area of the nozzle assembly coincides with a formation fluid chamber whereby power fluid flowing from the nozzle causes formation fluid to be introduced into the throat and thereafter discharged from the throat outlet along with the partially spent power fluid. The produced fluid outlet conveys the partially spent power fluid and the produced formation fluid uphole towards the surface of the ground where the liquid and gas phases of the produced fluid, as well as any water, can be subsequently utilized according to existing and known equipment that is available for this purpose.

The nozzle assembly of this invention can be provided with a packer nose assembly and a check valve to facilitate removing the assembly from the pump interior.

A primary object of the present invention is the provision of a downhole jet pump having a nozzle assembly that can be removed from the interior of the pump without the necessity of pulling the entire pump from the pump cavity.

Another object of the present invention is the provision of a downhole jet pump having a nozzle assembly that can be circulated into and out of the pump interior without the necessity of pulling the entire pump from the borehole.

A further object of this invention is the provision of a downhole pump of the fixed type having a nozzle assembly that can be circulated into and out of the pump interior without pulling the pump from the borehole.

Another and still further object of this invention is the provision of a downhole pump assembly of the free type that can be circulated into and out of the borehole and which further includes a nozzle assembly that also can be circulated into and out of the borehole independently of or in conjunction with the downhole pump.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENT

Figure 1:
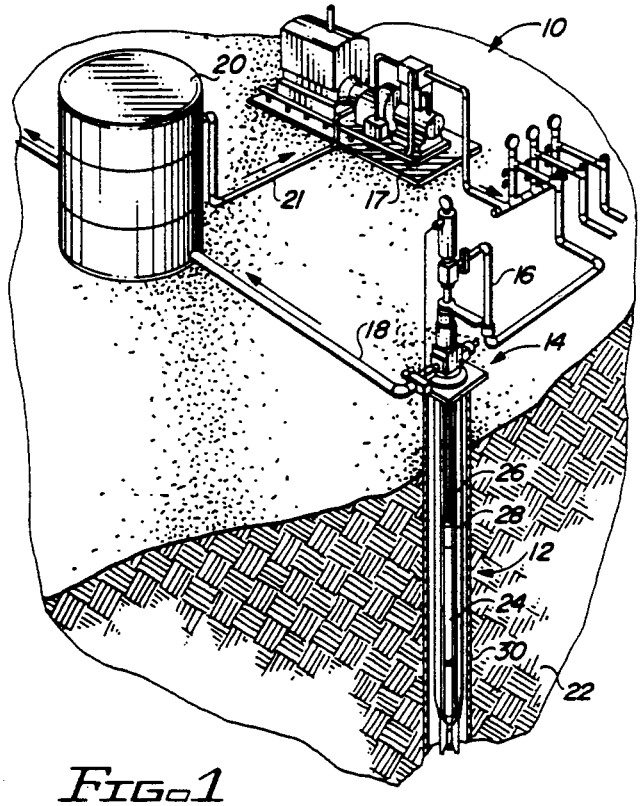
FIG. 1 is a part diagrammatical, part schematical, fragmentary view of a wellbore having apparatus associated therewith made in accordance with the present invention.
Figure 6:
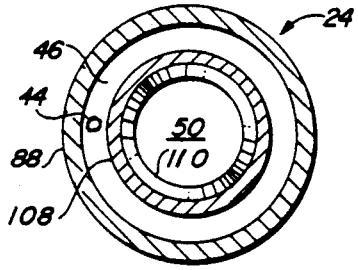
FIG. 6 is a cross-sectional view taken along line 6—6 of FIG. 2.
Figure 7:
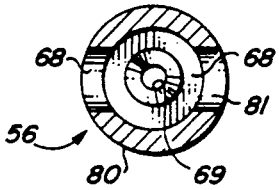
FIG. 7 is a cross-sectional view taken along line 7—7 of FIG. 4B.

In FIG. 1, there is disclosed an entire system 10 for producing a wellbore by using a hydraulic jet pump made in accordance with the present invention. The system 10 includes a borehole 12 that terminates in a wellhead 14 to which there is connected a power fluid supply 16 and a produced fluid outlet 18. The produced fluid at 18 is accumulated within a vessel 20. Fluid (liquid or gas) from vessel 20 is recirculated at 21 back to a pump 17 that provides the power fluid source at 16.

A hydrocarbon producing formation 22 provides fluid for a downhole jet pump 24 made in accordance with this invention. The jet pump 24 is connected to power fluid string 26 which is concentrically arranged within a produced fluid tubing 28 which is concentrically arranged within a casing 30 of the borehole.

Figure 3:
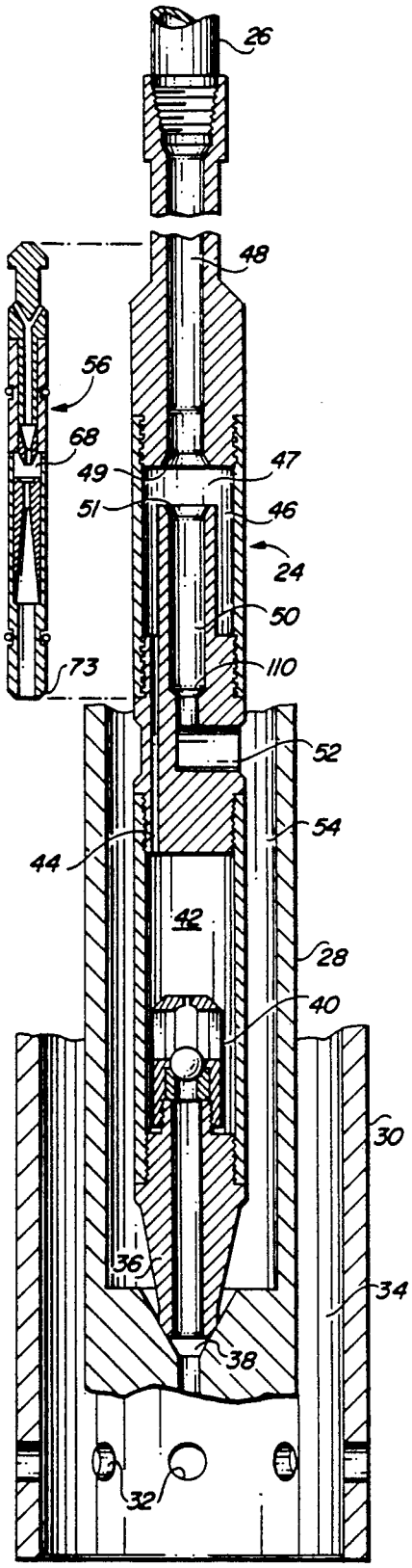
FIG. 3 is an enlarged, longitudinal, cross-sectional view of the apparatus disclosed in FIG. 2, with some parts being removed therefrom.
Figure 2:
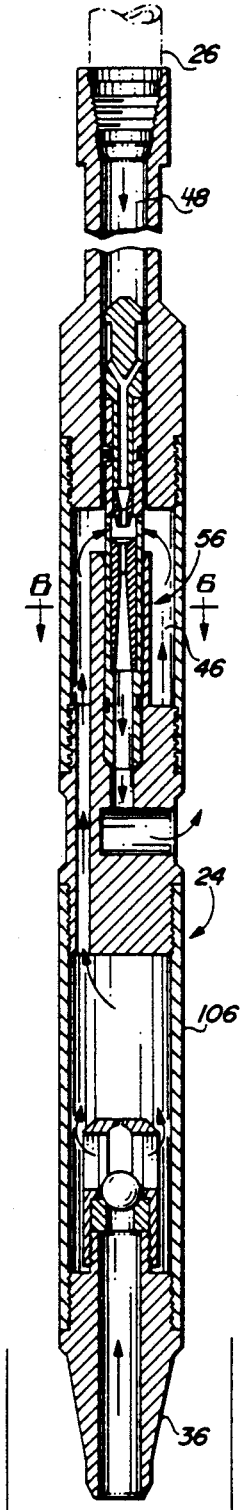
FIG. 2 is an enlarged, longitudinal, part cross-sectional view of part of the apparatus disclosed in FIG. 1.

In FIGS 2–7, and in particular FIG. 3, the casing 30 is seen to have perforations 32 by which formation fluid from formation 22 is introduced into an annulus 34, thereby providing the inlet end 36 of pump 24 with a suitable fluid supply at 38, 40, 42, 44 and 46. A ball check valve assembly 40 prevents downward flow of fluid that may be contained within a production inlet chamber 42.

At least one radial port 44 interconnects the production inlet chamber 42 with an annular production chamber 46. An intervening space 47 is in communication with chamber 42 by means of annulus 46 and radial passageway 44.

Power fluid passageway 48 is connected to power fluid tubing 26. The lower marginal length of power fluid inlet 48 forms part of a seating cavity and terminates at 49 and is in communication with the space that forms chamber 47.

Produced fluid outlet 50 has an inlet end 51 and an outlet port 52. The outlet port 52 communicates with annulus 54 of the production tubing 28, which in turn is connected to the produced fluid piping or tubing 28 18.

Figure 4A:
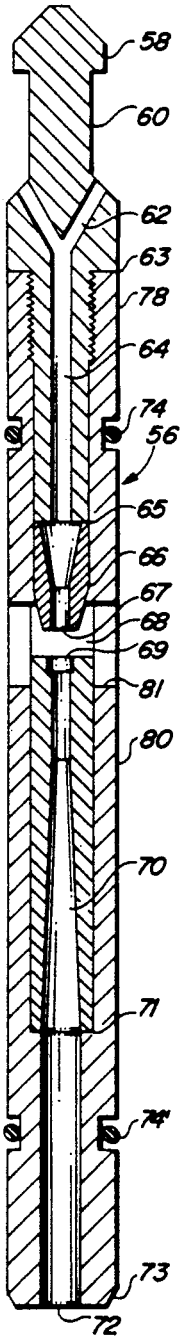
FIG. 4A is a longitudinal, cross-sectional view of part of the apparatus disclosed in FIGS. 2 and 3.
Figure 4B:
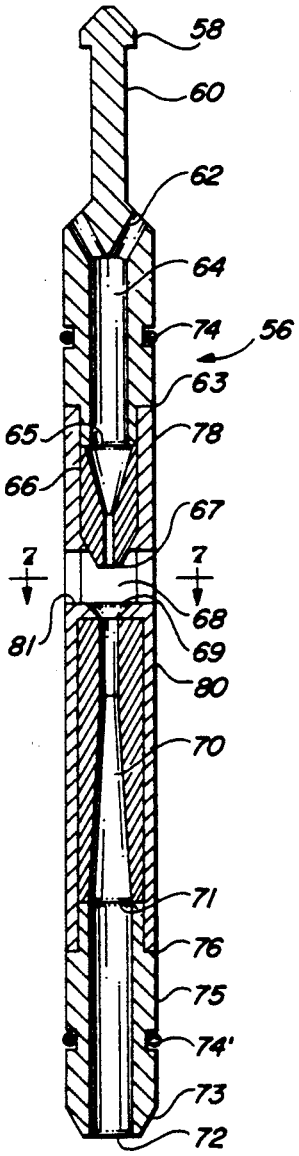
FIG. 4B is an alternate embodiment of the apparatus disclosed in FIG. 4A.

As particularly illustrated in FIGS. 4A and 4B, together with other figures of the drawings, a nozzle assembly 56 is removably received within the interior of and forms part of the jet pump 24. The nozzle assembly 56 has a fishing neck 58 at the upper end thereof which is reduced in diameter at 60 to provide space for a plurality of power fluid inlet ports 62. Port 62 communicate with power fluid passageway 64 to provide inlet end 65 of nozzle 66 with suitable source of power fluid. The nozzle has a discharge end 67 spaced from an inlet end 69 of an enlongated axially aligned throat 70. The throat 70 has a discharge end 71 in communication with outlet 72 of the nozzle assembly 56. Numeral 73 indicates a seating surface by which the assembly is received in sealed relationship within the main body of the pump as will be more fully appreciated later on. Spaced apart o-rings 74, 74' sealingly cooperate with the interior of spaced apart cylindrical passageways 48 and 50.

As best seen in FIG. 4B, the nozzle assembly is fabricated in three major pieces that threadedly engage one another in a manner to capture the nozzle and the throat therewith in spaced apart relationship with there being an uppermost member connected at 63 to an intermediate member 78 connected at 76 to a lowermost member 75.

Figure 5:
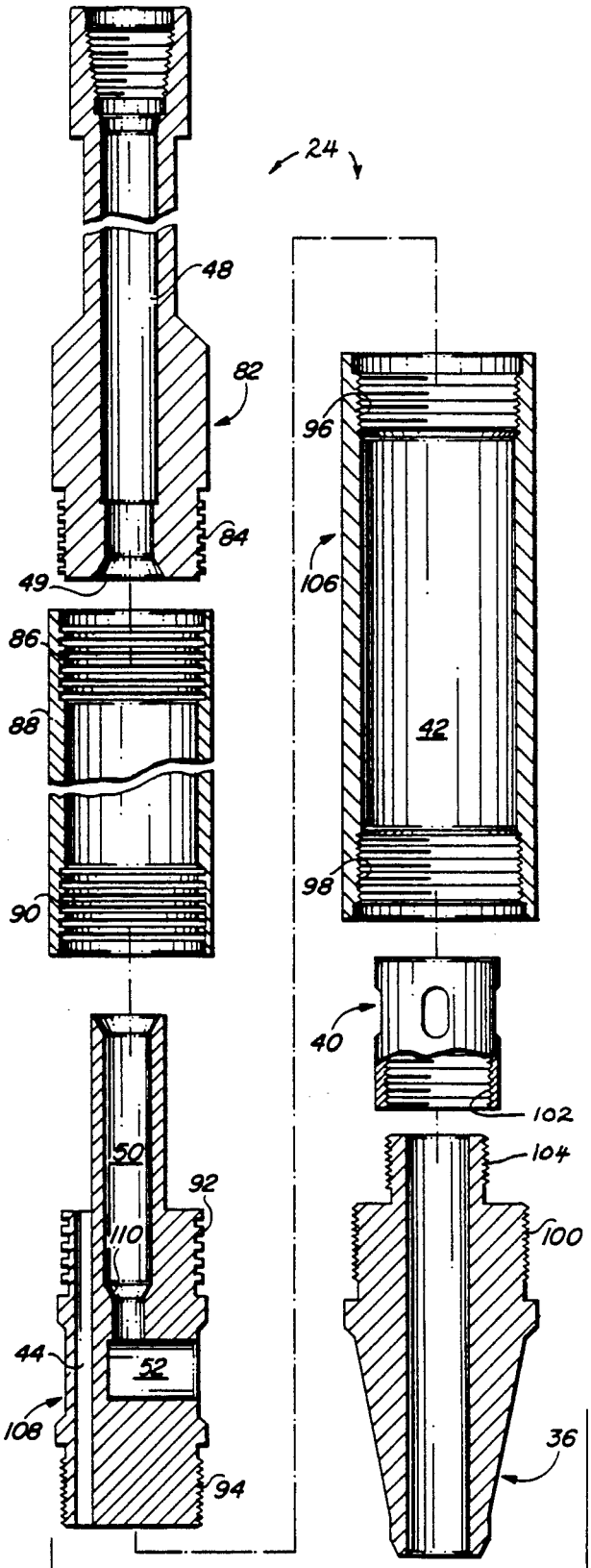
FIG. 5 is a longitudinal, cross-sectional, exploded view of part of the apparatus disclosed in FIG. 3.

In FIG. 5, an upper cylindrical body member 82 forms the before mentioned fishing neck and is threaded at 84 for threadly engaging upper threaded marginal end 86 of a central body member 88. The central body member 88 terminates in threads 90 that threadedly engages threaded surface 92 of a transfer sub 108. The transfer sub has a lower threaded end 94 that threadedly engages threads 96 of a lower cylindrical body member 106. The lower body member 106 is threaded at 98 for threadedly engaging threaded surface 100 of the before mentioned lower end 36 of the pump assembly 24. The check valve 40 is threaded at 102 and mates with threaded surface 104 of the foot or lower end 36 of the pump.

Figure 8:
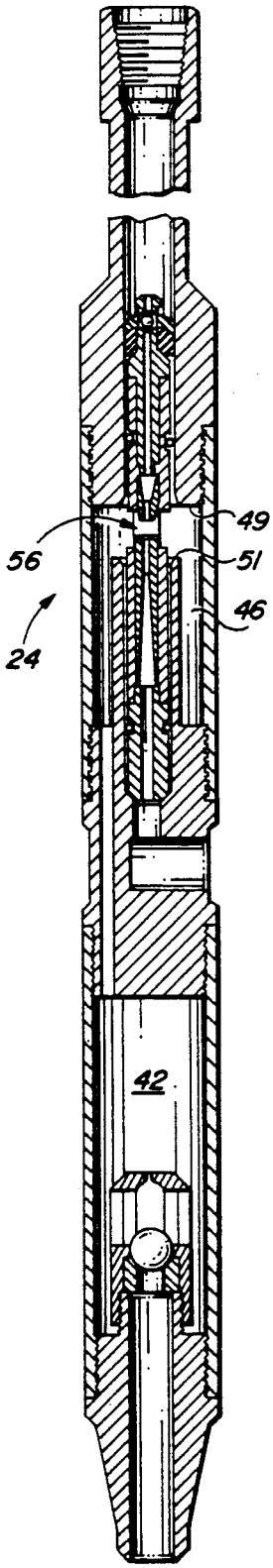
FIG. 8 is a longitudinal cross-sectional view of another embodiment of this invention.
Figure 9:
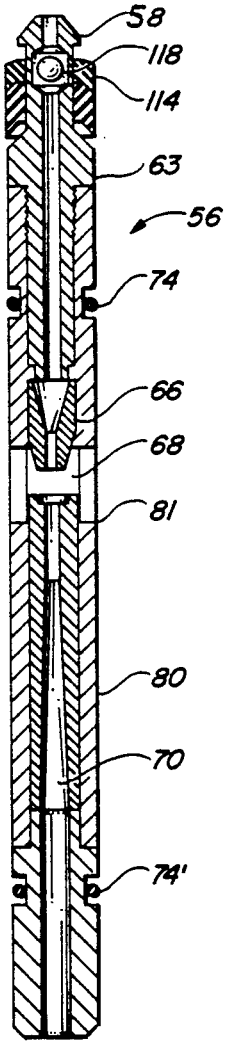
FIG. 9 is an enlarged, longitudinal view of part of the apparatus of FIG. 8.

FIG. 8 discloses an alternate embodiment of the invention that includes a packer nose assembly that can be incorporated into the present downhole hydraulically actuated jet pump. As seen in FIG. 9, a fishing neck 58 is spaced from one or more packers 114. The packer 114 is spaced above the nozzle assembly 56 and includes a one way check valve 118 which is positioned between the fishing neck and the nozzle assembly to permit flow of power fluid downhole to the nozzle assembly while preventing the flow of fluid back up through the packer nose assembly thereby increasing the pressure drop across the nozzle assembly when it becomes necessary to pump the nozzle assembly uphole from the pump interior.

In operation, the motor driven pump 17 receives a supply of fluid at 21 and delivers the fluid to the wellhead 14 where the fluid travels down the power fluid tubing 26 into the passageway 64 where the power fluid exits nozzle 66 and continues into the throat 70 while production fluid that may be present within chamber 47 is forced through the throat 70, through the outlet port 52, back up the annulus 54, to the surface of the ground where the produced fluid admixed with the spent power fluid is conveyed along piping 18 into the storage vessel 20.

The power fluid at 16 can be gas, crude oil, or water depending upon the availability of the substances and the quality and ratio of the gas, oil, water produced by the borehole.

The present invention is especially useful in producing a well having a formation that flows a large amount of gas admixed with a liquid. In this instance, the gas is recirculated at 21 and enhances the production rate by acting as a gas lift in addition to the jet action of the pump. Accordingly, the present invention includes the step of producing a borehole with a jet pump wherein gas is recirculated in the above described manner.

The surface 73 of the nozzle assembly abuts the seat 110 located at the lower end of the seating cavity 48 and 50 with the working area 68 of the nozzle assembly coinciding with the unobstructed formation fluid chamber 47 whereby the working area of the nozzle assembly is assured of a suitable supply of formation fluid and thereby holds the friction loses to a minimum.

The packer nose assembly of FIGS. 8 and 9 is especially useful where the nozzle assembly is relatively small in diameter respective to the tubing diameter.

I claim:

1. A downhole jet pump for producing fluid from a wellbore comprising a main body having a passageway extending therethrough; said passageway having an upper end and a lower end;

power fluid inlet means at the upper end of said passageway for connecting said pump to a source of power fluid, formation inlet means at the lower end of said passageway for connecting said pump to a source of formation fluid; a seating cavity formed between the upper end and the lower end of said passageway; said seating cavity is axially aligned with said upper end of said passageway;

said seating cavity having an upper cylindrical part spaced from a lower cylindrical part with there being a formation fluid working chamber formed therebetween;

a nozzle assembly removably and telescopingly received in a slidable and sealed manner within said seating cavity; said nozzle assembly has a longitudinal central axis that is aligned with said seating cavity and with the upper end of said passageway; said nozzle assembly being of a size to move axially into and out of said seating cavity, through the upper end of said passageway, and up through the power fluid inlet means by which the upper end of the passageway is connected to a source of fluid, thereby enabling the nozzle assembly to be circulated into and out of the pump pump seating when the pump is located within a wellbore;

said nozzle assembly has a nozzle and a throat mounted in fixed space relationship respective to one another and along a common longitudinal central axis that coincides with the longitudinal central axis of said seating cavity, said throat has an inlet spaced from an outlet of the nozzle; flow ports formed laterally in the nozzle assembly at a location between the nozzle and throat, thereby forming an area between the nozzle outlet and the throat inlet that coincides with said formation fluid working chamber;

means forming a produced fluid outlet that is connected to the lower end of said seating cavity through which produced fluid and spent power fluid that exits said throat can flow, said produced fluid outlet forms a flow path that is separate from said power fluid inlet means and from said formation fluid inlet means; whereby, power fluid flows through the nozzle and admixes with formation fluid from the working chamber and then formation fluid and spent power fluid flow through said produced fluid outlet.

2. The pump of claim 1 wherein said nozzle assembly is a longitudinally extending annular body having a seal means formed thereon for sealingly engaging said seating cavity, said nozzle assembly is connected to a packer nose assembly by which the pressure drop across the nozzle assembly is increased, and check valve means associated with said packer nose assembly for allowing fluid flow only in a downhole direction through said nozzle assembly.

3. The pump of cliam 2 wherein said seating cavity is formed in a member that has an upper marginal length that terminates in spaced relationship respective to a lower marginal length thereof, with said formation fluid working chamber being located therebetween; said nozzle assembly, when seated in the seating cavity, has lateral flow ports located between the nozzle outlet and throat inlet which are aligned to receive flow from said formation fluid working chamber.

4. The pump of claim 1 wherein the upper end of the passageway is connected to a power fluid tubing having an inside diameter greater than the outside diameter of said nozzle assembly; whereby, the nozzle assembly can be pumped uphole by reversing flow through said power fluid tubing.

5. The pump of claim 4 wherein said seating cavity is formed in a member that has an upper marginal length that terminates in space relationship respective to a lower marginal length thereof, with said formation fluid working chamber being located therebetween; said nozzle assembly has lateral flow ports located between the nozzle outlet and throat inlet which are aligned to receive flow from said formation fluid working chamber when said nozzle assembly is seated within said seating cavity.

6. The pump of claim 1 wherein the upper end of said passageway is connected to the end of a power fluid string and said nozzle assembly has an upper end connected to a packer nose assembly whereby said nozzle assembly and said packer nose assembly can be circulated into and out of the seating cavity by means controlling the direction of flow through the power fluid string and the produced fluid outlet.

7. The pump of claim 6 wherein the seating cavity is a member that has an upper marginal length terminating in spaced relationship respective to a lower marginal length thereof, with the formation fluid working chamber being located therebetween; said nozzle assembly has lateral flow ports located between the nozzle outlet and throat inlet which are aligned to receive flow from said formation fluid working chamber when said nozzle assembly is seated within the seating cavity.

8. The pump of claim 1 wherein said seating cavity is formed in a member that has an upper marginal length and a lower marginal length, the upper marginal length terminates in spaced relationship respective to a lower marginal length thereof with said formation fluid working chamber being located therebetween; said nozzle assembly has lateral flow ports located between the nozzle outlet and throat inlet which are aligned to receive flow from said formation fluid working chamber when said nozzle assembly is seated within said seating cavity.

9. The pump of claim 8 wherein said nozzle assembly is a longitudinally extending annular body having a seal means formed thereon for sealingly engaging said seating cavity, said nozzle assembly is connected to a packer nose assembly by which the pressure drop across the nozzle assembly is increased, and check valve means associated with said packer nose assembly for allowing fluid flow only in a downhole direction through said nozzle assembly.

10. A downhole jet pump for producing fluid from a wellbore comprising a main body having a passageway extending therethrough; said passageway has an upper marginal length and a lower marginal length;

conduit means at the upper end of said upper marginal length of the passageway by which the pump can be connected to a power fluid source, the lower end of said lower marginal length of the passageway has means that provides a formation fluid inlet; a seating cavity formed between the upper and lower marginal ends of said passageway;

a nozzle assembly having an upper and lower cylindrical part, said nozzle assembly is removably received within said seating cavity; said nozzle assembly includes a nozzle having an inlet end and an outlet end and a throat having an inlet end and an outlet end; means connecting said nozzle assembly to receive flow of the power fluid, said throat inlet end being spaced from the nozzle outlet end; the space between the nozzle outlet end the throat inlet end being in communication with a formation fluid working chamber;

said formation fluid working chamber is formed about a medial length of said seating cavity, said seating cavity having an upper cylindrical member for receiving an upper cylindrical part of said nozzle assembly therein and a lower cylindrical member for receiving a lower cylindrical part of said nozzle assembly therein; said upper and lower cylindrical members being spaced apart to communicate with said formation fluid working chamber which is unobstructed and axially receives a medial length of said nozzle assembly therethrough;

whereby, power fluid flowing through said nozzle assembly allows formation fluid to flow from the formation fluid working chamber, through the throat where it admixes with the spent power fluid, and flows through the produced fluid outlet and away from the pump.

11. The pump of claim 10 wherein said nozzle assembly is connected to a packer nose assembly by which the pressure drop across the nozzle assembly is increased, and further including check valve means for allowing fluid flow only downhole through said packer nose assembly and to said nozzle.

12. The pump of claim 11 wherein the pump is connected to a power fluid tubing having an inside diameter greater than the outside diameter of said nozzle assembly; whereby, the nozzle assembly can be pumped uphole by reversing flow through said power fluid tubing and effecting fluid flow into said produced fluid outlet, across the nozzle assembly, and up the tubing string.

13. The pump of claim 10 wherein said nozzle assembly is of relatively small diameter while said power fluid tubing is of relatively large diameter;

means producing a pressure drop across the nozzle assembly to enable the nozzle assembly to be pumped uphole and downhole through the power fluid tubing.

14. The pump of claim 10 wherein said seating cavity has an upper marginal length spaced from a lower marginal length with said formation fluid chamber being located therebetween; said nozzle assembly has lateral flow ports located between the nozzle outlet and throat inlet which are arranged to receive flow from said formation fluid working chamber.

15. The pump of claim 10 wherein said nozzle assembly is a longitudinally extending annular body having a seal means formed thereon for sealingly engaging said seating cavity, said nozzle assembly is connected to a packer nose assembly by which the pressure drop across the nozzle assembly is increased, and check valve means associated with said packer nose assembly for allowing fluid flow only in a downhole direction through said nozzle assembly.

16. The pump of claim 10 wherein said seating cavity is formed in a member that has an upper marginal length that terminates in spaced relationship respective to a lower marginal length thereof, with said formation fluid working chamber being located therebetween; said nozzle assembly has lateral flow ports located between the nozzle outlet and throat inlet which are aligned to receive flow from said formation fluid working chamber when said nozzle assembly is seated within said seating cavity.

17. In a system for producing fluid from a wellbore wherein a downhole jet pump has a main body with there being a passageway extending therethrough and the passageway having an upper end opposed to a lower end; there being power fluid inlet means at the upper end of said passageway for connecting the pump to a source of power fluid, formation fluid inlet means at the lower end of the passageway for connecting the pump to a source of formation fluid; and a produced fluid outlet through which spent power fluid admixed with formation fluid can flow; the improvement comprising:

said pump includes a nozzle and a throat affixed together in spaced relationship respective to one another and forming a unitary assembly for producing formation fluid in response to power fluid flowing therethrough;

a seating cavity formed between the upper end and the lower end of said passageway; said seating cavity is axially aligned with said upper end of said passageway; said seating cavity having an upper cylindrical part spaced from a lower cylindrical part with there being a formation fluid working chamber formed therebetween and connected to the formation fluid inlet;

said nozzle and throat assembly being removably and telescopingly received in a slidable and sealed manner within said seating cavity; said nozzle and throat assembly has a longitudinal central axis that is aligned with said seating cavity and with the upper end of said passageway; said nozzle and throat assembly being of a size to move axially into and out of said seating cavity, through the upper end of said passageway, and up through the power fluid inlet means by which the upper end of the passageway is connected to a source of fluid; whereby, the nozzle and throat assembly can be circulated into and out of the pump main body and uphole to the surface of the ground leaving the pump main body located downhole within the borehole.

18. The system of claim 17 wherein said nozzle assembly is a longitudinally extending annular body having a seal means formed thereon for sealingly engaging said seating cavity, said nozzle assembly is connected to a packer nose assembly by which the pressure drop across the nozzle assembly is increased, and check valve means associated with said packer nose assembly for allowing fluid flow only in a downhole direction through said nozzle assembly.

19. The system of claim 17 wherein the upper end of the passageway is connected to a power fluid tubing having an inside diameter greater than the outside diameter of said nozzle assembly; whereby, the nozzle assembly can be pumped uphole by reversing flow through said power fluid tubing.

20. The system of claim 17 wherein the upper end of said passageway is connected to the end of a power fluid string and said nozzle assembly has an upper end connected to a packer nose assembly whereby said nozzle assembly and said packer nose assembly can be circulated into and out of the seating cavity by means of the power fluid string and the produced fluid outlet.

21. The system of claim 17 wherein said seating cavity is formed in a member that has an upper marginal length that terminates in spaced relationship respective to a lower marginal length thereof, with said formation fluid working chamber being located therebetween; said nozzle assembly has lateral flow ports located between the nozzle outlet and throat inlet which are aligned to receive flow from said formation fluid working chamber when said nozzle assembly is seated within said seating cavity.

22. The system of claim 17 wherein said nozzle and a throat are mounted along a common longitudinal central axis that coincides with the longitudinal central axis of said seating cavity, said throat inlet is spaced from the nozzle outlet; flow port means formed laterally in the nozzle and throat assembly at a location between the nozzle outlet and throat inlet and thereby forming an area between the nozzle outlet and the throat inlet that is in communication with said formation fluid working chamber;

means by which the produced fluid outlet is connected to the lower end of said seating cavity through which produced fluid and spent power fluid that exits said throat can flow along a flow path that is separate from said power fluid and formation fluid;

whereby, power fluid can flow through the nozzle and admix with any fluid that may be present in said formation fluid working chamber and then flow through said produced fluid outlet.

* * * * *